United States Patent [19]

Rich et al.

[11] 4,428,521

[45] Jan. 31, 1984

[54] MULTI POSITION SHEET GUIDE

[75] Inventors: Lesley S. Rich, 1109 Prospect St., Somerset, Mass. 02726; Richard Skurka, Fall River, Mass.

[73] Assignee: Lesley S. Rich, Somerset, Mass.

[21] Appl. No.: 352,594

[22] Filed: Feb. 26, 1982

[51] Int. Cl.[3] ..... B65H 23/32; G03B 1/50; B65H 27/00

[52] U.S. Cl. ..... 226/199; 242/76

[58] Field of Search ..... 226/74, 75, 170–172, 226/196, 197, 199; 271/13, 17, 34, 247, 184, 185, 223; 242/57.1, 76

[56] References Cited

U.S. PATENT DOCUMENTS

| | | | |
|---|---|---|---|
| 2,904,333 | 9/1959 | Fife | 226/198 |
| 3,043,532 | 7/1962 | Seiden | 242/57.1 |
| 3,377,008 | 4/1968 | Sutton | 226/100 |
| 3,825,162 | 7/1974 | Hubbard | 226/74 |
| 3,997,093 | 12/1976 | Aizawa et al. | 226/198 X |
| 4,054,235 | 10/1977 | Witcher | 226/196 |

*Primary Examiner*—Leonard D. Christian

*Attorney, Agent, or Firm*—Robert J. Doherty

[57] ABSTRACT

A device for positioning the attitude of linear sheet having perforations along its edges with respect to a sheet processing machine such as a typewriter, printer, or computer peripheral equipment in such a manner that the sheet is supported while passing into or out of such machine in a wide variety of attitudes. Such adjustability of the device is achieved by separate first and second sheet guides mounted on a supporting base for independent height and rotational movement with respect thereto. In addition, the second of the sheet guides includes tractor support means whereby a pair of laterally spaced tractors which frictionally engage the sheet perforations thus guide the sheet into or out of the processing machine.

12 Claims, 6 Drawing Figures

MULTI POSITION SHEET GUIDE

BACKGROUND AND OBJECTS OF THE INVENTION

This invention is directed to a positioning device or guide for directing sheets such as documents having perforations along their opposed edges into and/or out of a variety of sheet processing machines such as a typewriter, printer, or computer peripheral equipment. As used hereinafter, the term printer shall include such aforementioned equipment as well as any other machines, devices, and the like which may advantageously accept such sheet material. In turn, the term sheet material preferably refers to marginally perforated and continuous sheet material but is broad enough to include non-continuous and non-perforated sheets as well.

Such printers are generally designed to feed sheet, i.e., paper, of two types, continuous form and single sheets. To accomplish the feeding of single sheets, a design known as friction feed is incorporated into the printer. In order to feed continuous form sheet, a machine generally incorporates some type of pin feed to engage marginally punched perforations in the paper or other sheet material. Such form feed mechanisms for moving paper through printers have been used for many years. They include sets of tractors or pin wheels mounted on the printer and directly driven through various drive means by the motor of the printer using gears, timing belts, etc. to drive a shaft which in turn drives the pin feed mechanism. These form feed mechanisms engage perforations provided in the sheet to drive it along a linear path through the printer.

One problem that presently exists is that many printers of the friction feed design do not have pin feed attachments available, or have such attachments available as an expensive option. Many of these machines also do not have the drive power to allow for the attachment of directly driven pin feed devices. This creates a situation which would make it very difficult for these friction feed machines to use continuous sheet forms for normal data processing, a sever disadvantage in the current printer marketplace.

A problem also exists in that some pin feed machines are designed for a fixed sheet width, thus not allowing the flexibility of using various widths of standard paper and forms. This situation causes additional cost to the user of such machines in the purchasing of special supplies made for that specific machine. Another problem in the current market is that distributors of such printers must inventory unique pin feed mechanisms for each machine due to difference in the locations of drive interfaces for each type of machine, and differences in body designs of each printer.

The device of the present invention directs itself to all of the mentioned problems. The subject invention allows for the feeding of marginally perforated, continuous form paper to friction feed printers. This is generally accomplished by using pin feed mechanisms purely as guides (not as drive mechanisms) for guiding the paper along a linear path while further preventing the paper from moving horizontally (side to side) either on the incoming side or on both sides (incoming and outgoing). The subject device also keeps multi-part perforated continuous form sheet from de-collating while it is driven through said printer.

The present device also allows for an adjustment in paper width which can be used in conjunction with fixed pin wheel type printers for using various paper widths. Due to the low torque of this invention, any paper can be engaged on one fixed pin wheel on such printer, and said paper can be guided in and out of the printer. Another major advantage of the present invention is its adjustability such that the sheet can be supported in a great variety of attitudes vis-a-vis the printer.

These and other objects of the present invention are accomplished by a device for positioning an edge perforated sheet in an exit and/or feed path with respect to a printer or the like for guiding said sheet while exiting and/or entering said printer, said device comprising a base including and upwardly generally vertically extending main support, bracket means connected to said main support, said bracket means in turn supporting separate first and second sheet guides for independent height and rotational movement, said first and second generally vertically spaced upper and lower guides each including a pair of laterally extending, generally parallel sheet support elements, said second guide further including sheet edge guide support means positioned forwardly of said second guide support elements and in turn adapted to support a pair of sheet edge guides in laterally spaced and adjustable positions at the lateral edges of said sheet path.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 3:
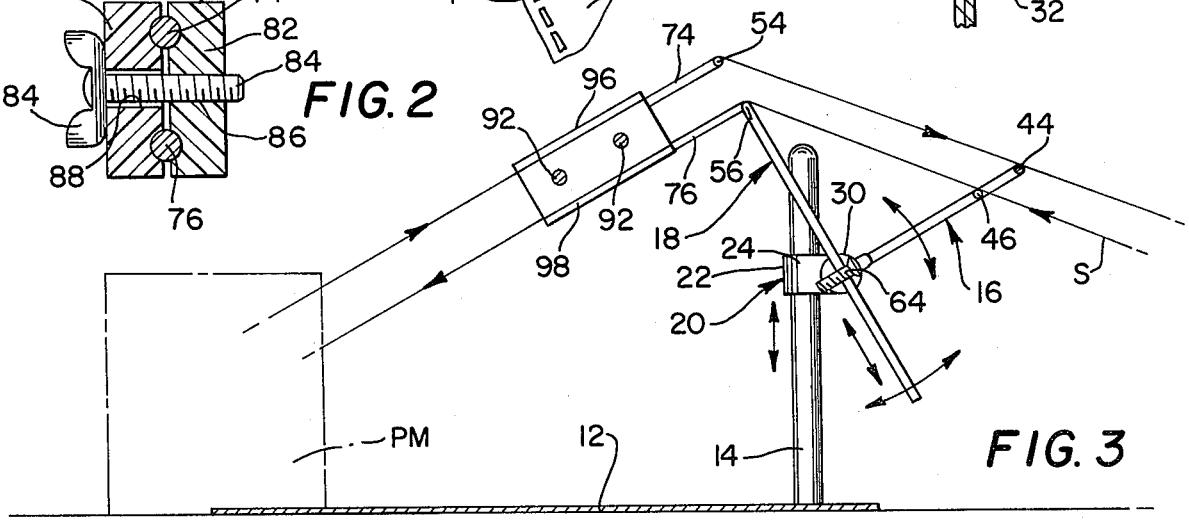
FIG. 3 is a side elevational view of the device shown in FIG. 1 with the sheet processing machine or printer shown in phantom to the left and particularly illustrating the manner in which the device may be used to support both incoming and outgoing sheets from such printer or processor.

Turning now to the drawing, the positioning and guide device 10 of the present invention is illustrated. The device includes a generally planar base 12 of any desired configuration and preferably of adequate weight such that a pair of laterally spaced upright support posts 14 and the mechanisms in turn supported therefrom will not cause the device to be unstable when rested upon a support S or the like. In addition, the base 12 is of an extent such that its forward end, that is, the side to the left in FIG. 3 is of an extent such that it may be placed beneath a portion of a processing machine (PM) and in that manner be additively or alternately supported for stable placement. The processing machine as previously indicated may be a typewriter, a printer or peripheral computer support equipment, the only necessary thing being that sheet materials generally including linearly spaced edge perforations is processed thereby, that is, printed upon, etc. The sheet S may be of any material, generally paper, but not limited thereto.

Figure 1:
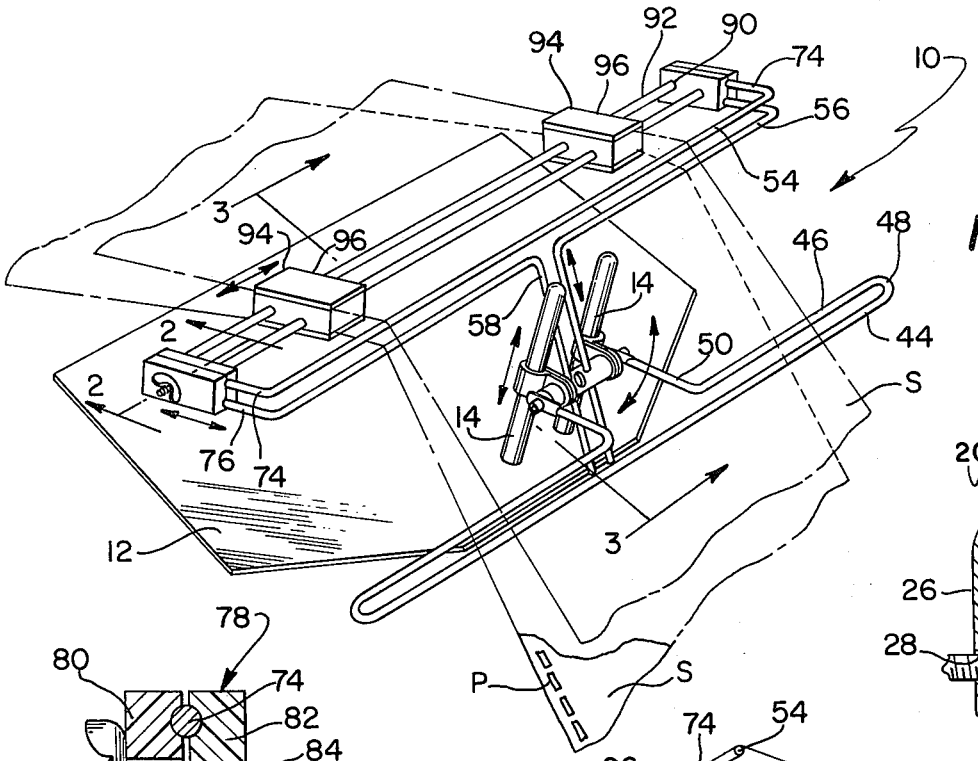
FIG. 1 is a perspective view of the guide device of the present invention showing its various modes of adjustability as well as the incoming and outgoing sheets shown in phantom.
Figure 6:
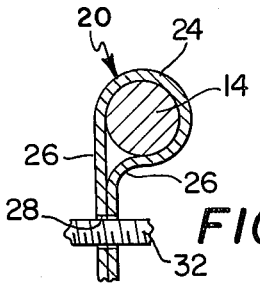
FIG. 6 is an plan view of one of the clamps by which elevational movement relative to the posts may be achieved.
Figure 2:
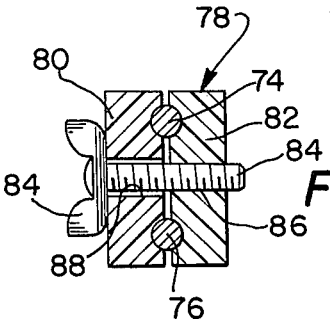
FIG. 2 is an enlarged sectional view taken along the line 2—2 of FIG. 1.

The posts 14 are attached to the base 12 by any suitable means such as recessed screws (not shown) and the like. First and second sheet guides 16 and 18 respectively are supported from the posts by means of bracket assembly 20. The bracket assembly 20 includes a pair of friction clamps 22 which are adapted to encircle the posts 14 (see particularly FIG. 6) and enable the bracket assembly to slide up and down thereon dependent on the friction exerted on such clamps 22. The clamps include a band portion 24 which is adapted to encircle the post and forwardly extending portions 26 having openings 28 disposed therethrough such that when such extensions 26 are clamped together a force is exerted on the band portions 24 causing such to frictionally and tightly engage the posts.

The clamp assembly 20 further includes a central body portion 30 into which a pair of body extensions 32 are adapted to threadably engage. The body extensions 32 include a threaded bolt 34, a spacer 36 having a central bore 38 provided therethrough, and a washer 40. The bolt 34 is adapted to extend through the bore 38 of the spacer 36, through openings 28 in the band extensions 26 and thence into a threaded bore 42 provided at each end of the main body portion 30. In this manner then, the appropriate action is provided to securely but adjustably position the clamp assembly 20 upon the posts 14.

Figure 4:
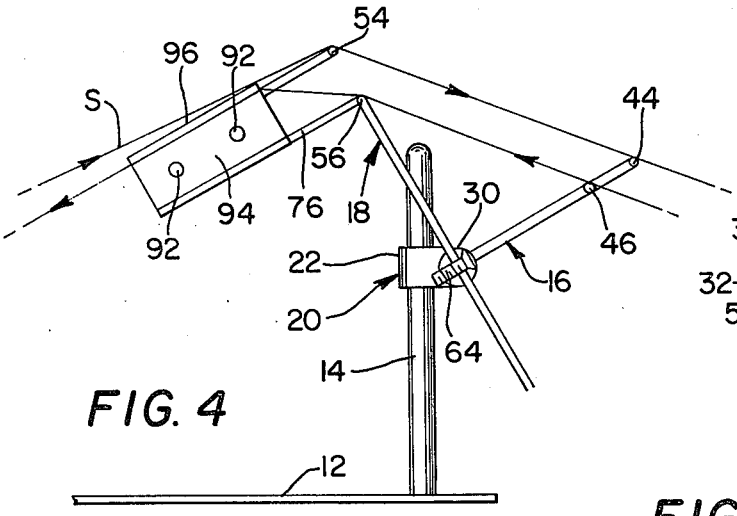
FIG. 4 is a side elevational view similar to FIG. 3 but showing an alternate path arrangement whereby the incoming sheet is engaged by the tractor and the exiting sheet is not.
Figure 5:
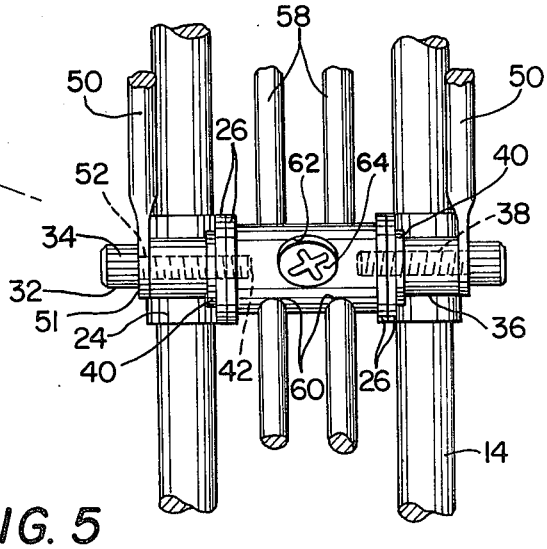
FIG. 5 is an enlarged partial rear elevational view showing a specific manner by which relative adjustability of the various component parts is achieved.

The first sheet guide 16 includes a pair of generally parallel, laterally extending rods 44 and 46 which respectively define upper and lower sheet support elements. The ends of the rods 44 and 46 may be interconnected as shown at 48 while the lower rod 46 is centrally interrupted and provided with a pair of downwardly extending rod extensions 50. Such rod extensions are generally parallel to each other, laterally spaced and form a stem to the overall T-shaped configuration of the first guide 16. The extensions 50 terminate in flattened ends 51 which in turn are provided with a bore 52 to receive the shaft of the threaded bolt 34 between the head thereof and the spacer 36. In this manner then, the first sheet guide 16 is attached to the clamp assembly 20 and capable of independent arcuate movement relative thereto dependent upon the extent to which the bolts 34 are engaged to the body 30. A sheet S may be laterally supported both on the lower support element 46 and the upper support element 44 in the manner as shown in FIGS. 3 and 4. Also, the height and relative positioning of such first guide 16 vis-a-vis the posts 14 may be varied in a wide variety of positions by a combination of arcuate movements of the stem extensions 50 about the body 30 and by movement of the clamp assembly 20 upwardly or downwardly upon the shafts 14.

The second sheet guide 18 is also of a somewhat T-shape configuration and includes upper and lower parallel rods 54 and 56 which respectively form upper and lower support elements for the second sheet guide 18. The lower rod 56 is centrally broken and provided with a pair of downwardly extending parallel rod extensions 58 laterally spaced and generally parallel to each other to form the stem of the overall T configuration. In this regard, the body 30 is provided with a pair of laterally spaced bores 60 through which the stem rods 58 are adapted to extend. The body 30 is also provided with a radially extending counter bore 62 which at least partially connects with the bores 60. The counter bore 62 includes a lower threaded portion which is adapted to engage with a set screw 64, portions of which in turn are adapted to contact the rod extensions 58 so as to apply frictional force thereon and in that manner secure the second sheet guide 18 to the clamp assembly 20. Also, dependent upon the force by which the body extensions 32 are engaged to the body 30, the body 30 is adapted to rotate within limits with respect to the supporting posts 14. Accordingly, similar to the first sheet guide 16, the second sheet guide is able to assume a wide variety of height and front to rear spacing positions relative to the supporting posts 14 such that a sheet may be guided into a processing machine PM from almost any desired attitude.

The rods 54 and 56 of the second sheet guide 18 are further provided with forwardly extending generally L-shaped extensions 74 and 76 which in turn are adapted to support a clamp 78 having opposed sections 80 and 82. The opposed sections of the clamp 78 may be secured upon the rod extensions 74 and 76 by means of thumb screw 84 adapted to threadably engage a threaded bore 86 and one of the clamp sections 82 after extending through an unthreaded bore 88 in the other section 80. The inner clamp section 82 is further provided with a pair of longitudinally spaced bores 90 into which the ends of a pair of sheet edge guide or tractor support rods 92 are adapted to extend. The sheet edge guide or tractor support rods 92 are in turn adapted to support a pair of sheet edge guides 94 for adjustable lateral positioning thereon. The sheet edge guides may in their simplest form be sheet metal (or other material) guides to simply engage the edges of sheet S but preferably include a pin wheel type mechanism to engage the edge perforations of sheet S, i.e., tractors.

The tractors 94 are of known configuration and include upper and lower spring biased covers 96 and 98 respectively and an endless belt (not shown) having a series of outwardly extending protrusions provided thereon. The sheet S is adapted to extend between either of the cover pairs 96 or 98 and the endless belt such that the protrusions extend through the edge opening provided on such sheet. Also, the tractors 94 are not provided with drive means and in such respect both of the rods 92 which provide the mounting support therefor are smooth, that is, are not provided with gears. Tractors of such configuration are known and may be purchased from Precision Handling Devices, Inc. of Assonet, MA. 02702 and in alternate forms with upper covers 96 only, so as to guide the sheet in the feed direction towards a processing machine PM or with both upper and lower covers 96 and 98 such that the feed and exit from a processing machine may be guided. In this respect, the disclosure of U.S. Pat. No. 3,825,162 issued July 23, 1974 and which describes such a Precision Handling Devices, Inc. tractor is herewith specifically incorporated by reference into the present specification. It should be brought out that tractors 94 are not utilized as positive feed devices but are used as guides for the sheet S; and in such respect, each of the tractors 94 is provided with known means for frictionally clamping such in a variety of spaced-lateral positions upon the guide rods 92. In addition, it should also be apparent that by manipulation of the thumb screw 84 that the clamping block 80 may be moved relative to the rod extension 74 and 76 such that tractors 94 may be positioned towards and away from a processing machine PM in addition to the other relative movements afforded by the overall movement of the second sheet guide 18.

The present device 10 may be utilized to either positively guide sheet S into a processing machine PM or alternatively be utilized to both positively guide sheet into and out of such a machine, that is, the sheet feed may be either for uni-directional or bi-directional feed. When bi-directionally feeding sheet, the format utilized by FIG. 3 is preferably utilized. Therein, the sheet S extends through the open slot formed by the support rods 44 and 46 of the first sheet guide 16 and is supported by contact on the upper part of the lower rod 46. Thence the sheet passes forwardly, that is, to the left as viewed in FIG. 3 over the tops of the posts 14 and into contact with the upper portion of the lower support rod 56 of the second sheet guide 18. The sheet then passes into contact with the lower portion of the tractors 94, that is, between the lower covers 98 and the free-moving belt provided with the protuberances which extend into the edge openings provided on opposite sides of the sheet. The sheet is, accordingly, guided in the desired manner and at the proper attitude and orientation with respect to the processing machine PM.

The processing machine then prints or otherwise processes the sheet, and thereafter it exits from the machine and passes through the upper portion of the tractors 94 where it is positively guided in the exit direction. Thence the sheet in its exit path passes over the second guide upper support rod 54 and thence over the posts 14 and into supportive contact with the first guide upper support rod 44. In this manner, then the processing machine PM may positively engage the sheet S, move it in either a feed or exit direction while the guide device 10 of the present invention insures positive guiding of the sheet into either of such directions.

Alternatively, the sheet may be positively guided only in the feed direction in which case the sheet path illustrated in FIG. 4 would be the preferred operational manner. The sheet path taken therein is similar to that of FIG. 3 but after passing over the second guide lower support 56 upwardly extends into the upper track of the tractor 94 and thence into the machine PM. Upon exiting the machine PM, the sheet passes over the tractor 94 but not in engaged contact therewith and thence for supportive contact with the upper support rods 54 and 44 of the second and first sheet guides 18 and 16 respectively in the same manner as achieved in the bi-directional sheet feeding shown in FIG. 3.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A device for positioning an edge perforated sheet in an exit and/or feed path with respect to a printer or the like for guiding said sheet while exiting and/or entering said printer, said device comprising a base including and upwardly generally vertically extending main support, bracket means connected to said main support, said bracket means in turn supporting separate first and second sheet guides for independent height and rotational movement, said first and second generally vertically spaced upper and lower guides each including a pair of laterally extending, generally parallel sheet support elements, said second guide further including sheet edge guide support means positioned forwardly of said second guide support elements and in turn adapted to support a pair of sheet edge guides in laterally spaced and adjustable positions at the lateral edges of said sheet path.

2. The device of claim 1, said main support generally laterally centrally disposed relative to said base and said sheet guides.

3. The device of claim 2, said sheet guide elements and said sheet edge guide support means comprising laterally extending generally parallel rods.

4. The device of claim 3, said sheet edge guide support means adjustably movable towards and away from the support elements of said second guide in a generally horizontal plane defined by said generally parallel rods of said sheet edge guide support means.

5. The device of claim 3, said sheet guides being generally T-shaped with the lower of each of the rods thereof having a centrally disposed stem portion downwardly extending for connection with said bracket means.

6. The device of claim 5, said bracket means adapted for slidable adjusting movement along the longitudinal extent of said main support.

7. The device of claim 1 or 6, said main support being a pair of laterally spaced upright posts, said bracket means including a central body extending between said posts and body extensions disposed to either side thereof, said central body rotatable about a generally horizontal axis with respect to said post, said first and second guide means separately connected to said bracket means.

8. The device of claim 7, said second guide means stem connected to said bracket means central body, said first guide means lower rod being centrally broken with laterally spaced parallel rod extensions forming said first guide stem, said first guide stem connected to said bracket means at opposite sides of said body extensions.

9. The device of claim 7, said bracket means including a pair of frictional slide clamps engaged to said upright posts, said body extensions screw engaged to said central body, said pair of slide clamps disposed between each said body extensions and said body whereby tightening and loosening of said body extensions respectively tightens and loosens said clamps with respect to said posts.

10. The device of claim 3, said second sheet guide rods laterally terminating in L-shaped extensions which in turn support a pair of end blocks adjustably slidable along said L-shaped extensions, said end blocks in turn adapted to receive the opposite ends of said sheet edge guide support rods such that said sheet edge guide supports are adjustably positionable towards and away from said second sheet guide rods.

11. The device of claim 10 wherein said sheet edge guide support rods and said second sheet guide rods and their extensions define generally parallel generally horizontally oriented planes with the plane defined by said sheet edge guide support rods disposed intermediate said other planes.

12. The device of claim 1, said sheet edge guides being tractors each having an endless belt adapted to engage the spaced edge perforations of said sheet, said belt mounted for free rotation with respect to said tractors.

* * * * *